US006964123B2

(12) United States Patent
Vicale

(10) Patent No.: US 6,964,123 B2
(45) Date of Patent: Nov. 15, 2005

(54) LAMINATED FIREARM WEAPON ASSEMBLY AND METHOD

(76) Inventor: Emil Vicale, 1C Sunrise Rd., Danbury, CT (US) 06810

( * ) Notice: Subject to any disclaimer, the term of this patent is extended or adjusted under 35 U.S.C. 154(b) by 0 days.

(21) Appl. No.: 10/678,239

(22) Filed: Oct. 3, 2003

(65) Prior Publication Data

US 2005/0188585 A1 Sep. 1, 2005

(51) Int. Cl.[7] ..... F41C 27/00
(52) U.S. Cl. ..... 42/106; 42/75.1; 42/71.01
(58) Field of Search ..... 42/71.01, 106, 42/75.1

(56) References Cited

U.S. PATENT DOCUMENTS

| | | | | | |
|---|---|---|---|---|---|
| 1,025,550 | A | * | 5/1912 | Tilton | 42/71.01 |
| 2,439,137 | A | * | 4/1948 | Keller | 428/171 |
| 2,563,923 | A | * | 8/1951 | Crosby | 42/71.01 |
| 2,965,994 | A | * | 12/1960 | Sullivan | 42/71.01 |
| 3,023,527 | A | * | 3/1962 | Leek et al. | 42/71.01 |
| 3,659,577 | A | * | 5/1972 | Richardson et al. | 124/88 |
| 3,850,156 | A | * | 11/1974 | Eicholtz | 124/23.1 |
| D241,836 | S | * | 10/1976 | Ruger | D22/103 |
| 4,674,216 | A | * | 6/1987 | Ruger et al. | 42/71.01 |
| 4,934,084 | A | * | 6/1990 | Thomas | 42/71.01 |
| 5,054,224 | A | * | 10/1991 | Friar et al. | 42/76.02 |
| 5,388,363 | A | * | 2/1995 | Smart | 42/71.01 |
| 6,073,381 | A | * | 6/2000 | Farrar et al. | 42/71.02 |
| 2004/0060219 | A1 | * | 4/2004 | Weinraub | 42/70.11 |
| 2004/0123856 | A1 | * | 7/2004 | Finstad | 124/56 |

* cited by examiner

*Primary Examiner*—Michael Carone
*Assistant Examiner*—Troy Chambers
(74) *Attorney, Agent, or Firm*—Hosmer & Reiter; Howard S. Reiter, Esq.

(57) ABSTRACT

In a low-cost firearm, the frame of the weapon comprises a laminated structure in which operative grooves and recesses having a base wall and one or more sidewalls are formed by laminating the sidewall to the base wall, so as to avoid the necessity for forming the grooves and recesses by performing expensive machining and finishing operations on a unitary frame structure. The sidewalls and the base walls are formed of separate materials that may be different from each other. For example one of the materials may be plastic, to provide light weight, while the other may be metal to achieve desired rigidity and/or strength. The laminations are coupled together by either mechanical members such as screws or rivets, or by bonding agents such as welding or high-strength adhesives or by a combination of both.

4 Claims, 4 Drawing Sheets

LAMINATED FIREARM WEAPON ASSEMBLY AND METHOD

FIELD OF THE INVENTION

This invention relates generally to explosive firearms, and more particularly to hand-held firearms that are exceptionally light in weight and inexpensive to manufacture, and the method of making them. It is well-known that high-quality firearm weapons of the type that fire explosive projectiles, made in accordance with the prior art, are relatively expensive to manufacture; this is attributable in significant part to the high precision and close tolerances required in the manufacturing process in order to assure that the resulting weapon will be safe, reliable and reproducible in quantity.

In general, firearms currently are manufactured using quality metals and precision casting techniques in association with expensive and labor-intensive secondary manufacturing operations such as milling, grinding, broaching, and the like. These expensive and time-consuming machining operations are necessary to produce solid unitary frames that are currently used, and to assure the surface finish of the numerous grooves, bores, recesses and other shapes in such frames, that are required to achieve the various mechanical functions of a modern firearm. That is, in the normal course of use of a weapon, various separate elements of the weapon must rotate, pivot, slide, and/or reciprocate relative to each other. Often, the shapes of the various recesses and projections needed to allow these relative movements to take place are exceedingly complex; for example, a circular diameter hole extending along one axis, may be intersected by a rectangular cross-section channel extending along another axis forming an acute angle with the first.

The forming and machining operations needed to produce complex shapes of this kind are difficult and expensive. Further, the one-piece precision cast parts on which these operations are performed are expensive to produce and the parts tend to be relatively heavy. This is generally a result of the nature of the metals needed to satisfy the requirements of both the casting and machining operations.

DESCRIPTION OF THE INVENTION

This invention generally permits avoidance of, or substantially reduces requirements for, the expensive, labor-intensive casting and machining operations that are required for the manufacture of high-quality weapons, of substantially conventional type, in accordance with the prior art.

In accordance with this invention, the frame of a weapon as well as various parts that are intended to be attached to the frame, are formed by a unique process of laminating together relatively thin, non-integral thicknesses of material having aligned, generally planar, shapes. Because these laminations are generally planar, that is, of uniform thickness throughout, the shape of each lamination can be formed with great precision by inexpensive processes such as stamping and blanking. Even though the laminations in most cases will be characterized by uniform thickness, it should be understood that certain parts of the surface area of some laminations may be made to vary from uniformly flat configuration so as to create and or conform to non-planar shapes such as the interior or exterior surface of a tube or cylinder or sphere. In most applications, these non-planar portions of the surface of a lamination will not be directly abutted against an adjacent surface of another lamination. When the laminations have been properly aligned and joined together, the various stacked shapes cumulatively define shaped and precisely dimensioned three-dimensional configurations including curves, grooves, bores, channels, blind holes and various other recesses, intersecting or not, of relatively unlimited complexity. The recesses and other shapes that are thus formed then serve to receive and/or mate with fixed and movable parts of the finished weapon in a conventional manner. If additional finishing or machining operations are required for the cumulatively defined recesses of the laminated structure, the nature and cost of such operations, as well as the aggregate time required for their completion, have been found to be significantly less than what would be required for construction of the same or an equivalent non-laminated structure in accordance with the prior art.

SUMMARY OF THE INVENTION

In the disclosed embodiment of the invention, the structure of a conventional weapon such as a handgun is viewed as having been sliced into thin layers generally parallel to the plane defined by two intersecting, long dimensions. The position and thickness of the layers may be chosen to coincide with or to cut through particularly complex shapes, so as to break the shapes into less complex and/or more convenient elements. As a highly simplified example: a part having a solid body with a trough-shaped recess defined by a bottom, two parallel side walls and two spaced apart end walls, could be "sliced" parallel to the bottom at the juncture of the bottom with the side walls and the end walls so that the two resulting laminations would then comprise one having the bottom surface on its face, and another one having a thickness equal to the depth of the desired trough and a through opening representing the shape of the trough.

Accordingly, it is one object of this invention is make possible the fabrication of precisely formed, frames and parts for weapons at substantially reduced cost.

Another object is the provision of reliable weapons that can be fabricated without reliance on ongoing, difficult, labor-intensive manufacturing operations.

Still another object of this invention is the creation of a manufacturing process for weapons that is low in overall cost, that is reliable, and that is capable of providing parts and frames that are both reliable and reproducible and interchangeable.

These and other objects, features and advantages of this invention will be made more apparent to those having skill in this art, by reference to the following specification considered in conjunction with the accompanying drawings, in which:

DETAILED DESCRIPTION OF THE PREFERRED EMBODIMENT

In the following description, certain specific details of the disclosed embodiment such as weapon types, shapes, positions and techniques, etc, are set forth for purposes of explanation rather than limitation, so as to provide a clear and thorough understanding of the present invention. However, it should be understood readily by those skilled in this art, that the present invention may be practiced in other forms and embodiments which do not conform to the details set forth herein, without departing significantly from the spirit and scope of this disclosure. Further, in this context, and for the purposes of brevity and clarity, detailed descriptions of well-known apparatus and techniques have been omitted so as to avoid unnecessary detail and possible confusion.

Figure 1:
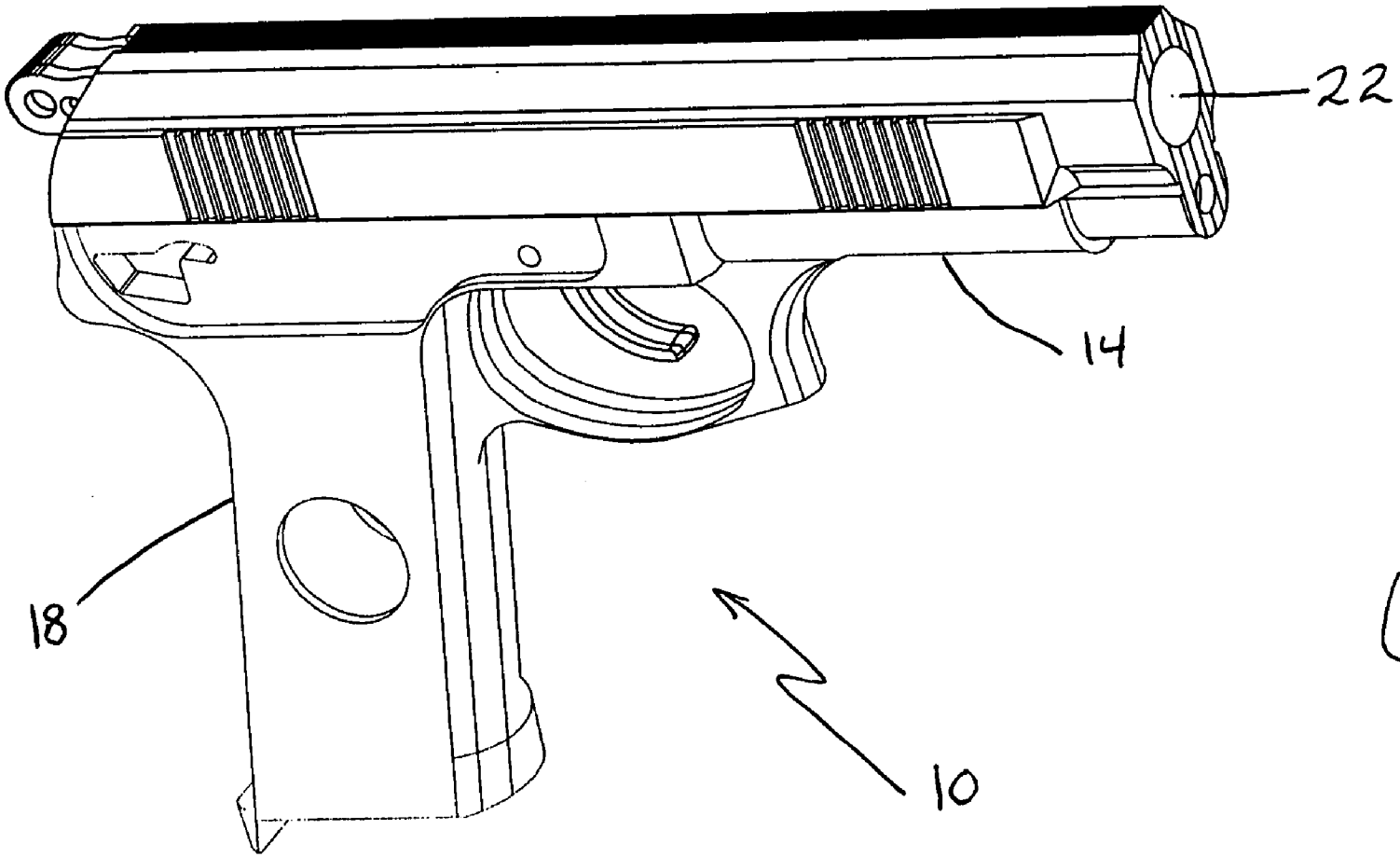
FIG. 1 is a simplified pictorial representation of a partially completed weapon fabricated in accordance with this invention.

Referring now to FIG. 1 of the drawings, a weapon 10 representing a hand-held firearm fabricated in accordance with this invention may be seen to comprise generally a frame 14 having a grip portion 18, a barrel passage 22 for receiving a barrel (not shown), a breech chamber 48 space associated with the barrel passage 22 for receiving explosively-propelled projectiles [i.e. ammunition], a trigger 50, and a trigger guard 58. It is acknowledged that all of these elements of a weapon are entirely well-known and conventional in form and function. Both the fundamental elements of a firearm weapon and their related form and function are well-known to those having ordinary skill in this art, and in general they will not be described in detail herein. In this regard, it is known to those having skill in this art, that the barrel through which explosive projectiles are propelled, is subjected to extraordinary stress and force in use and further, the interior surface of a gun barrel must be controlled and finished to extremely close tolerances.

Accordingly, although it is conceivable that a barrel may be constructed within the scope of this invention, at this time it is contemplated that conventionally formed, one-piece barrels will be mechanically integrated with a laminated weapon structure/frame to complete a weapon in accordance with the invention herein disclosed.

In accordance with the novel aspects of this invention, the structural elements of weapon 10, including, but not limited to, frame 14, are shown to comprise a plurality of relatively thin, parallel, sheet-like laminations 60 arranged in parallel, stacked (i.e. laminated), side-by-side relationship. The method of forming one or more elements of a lightweight firearm weapon in accordance with this invention comprises determining the shape of each lamination by deciding first upon a planar orientation for the laminar interfaces, then selecting a base plane which will most often lie outside the structure of the weapon frame or element that is being constructed, and then creating plan views of that frame or element parallel to and at selected different distances from the base plane. That is, three coordinate axes are selected that define the desired element or elements of the weapon in three dimensions, and the laminations are created corresponding to plan views of the elements taken parallel to two of the coordinate axes and at sequential positions along the third of said coordinate axes; the result being the formation of a three-dimensional element wherein the thickness of the element represents the cumulative thickness of each of said laminations, combined.

In accordance with this aspect of the invention, each plan view will correspond to one laminar thickness of the weapon frame or element that is to be fabricated. The thickness of each lamination accordingly may be adjusted to correspond to the complexity of the changes in the plan view of the frame or element as the distance from the base plane increases or decreases. For example, if the base plane is selected to lie parallel to the longitudinal axis of the barrel of a weapon, and a central thickness of the weapon extending through the axis of the barrel is unchanged for a thickness of, say, one-quarter inch, then the central lamination may be one quarter inch thick, while the laminations on either side of the central lamination may be substantially thinner, say one-thirty second of an inch, or less, to accommodate changes in the shape of the outer surface of the trigger guard, or to mark the start of an internal channel or recess within the weapon frame.

Figure 2:
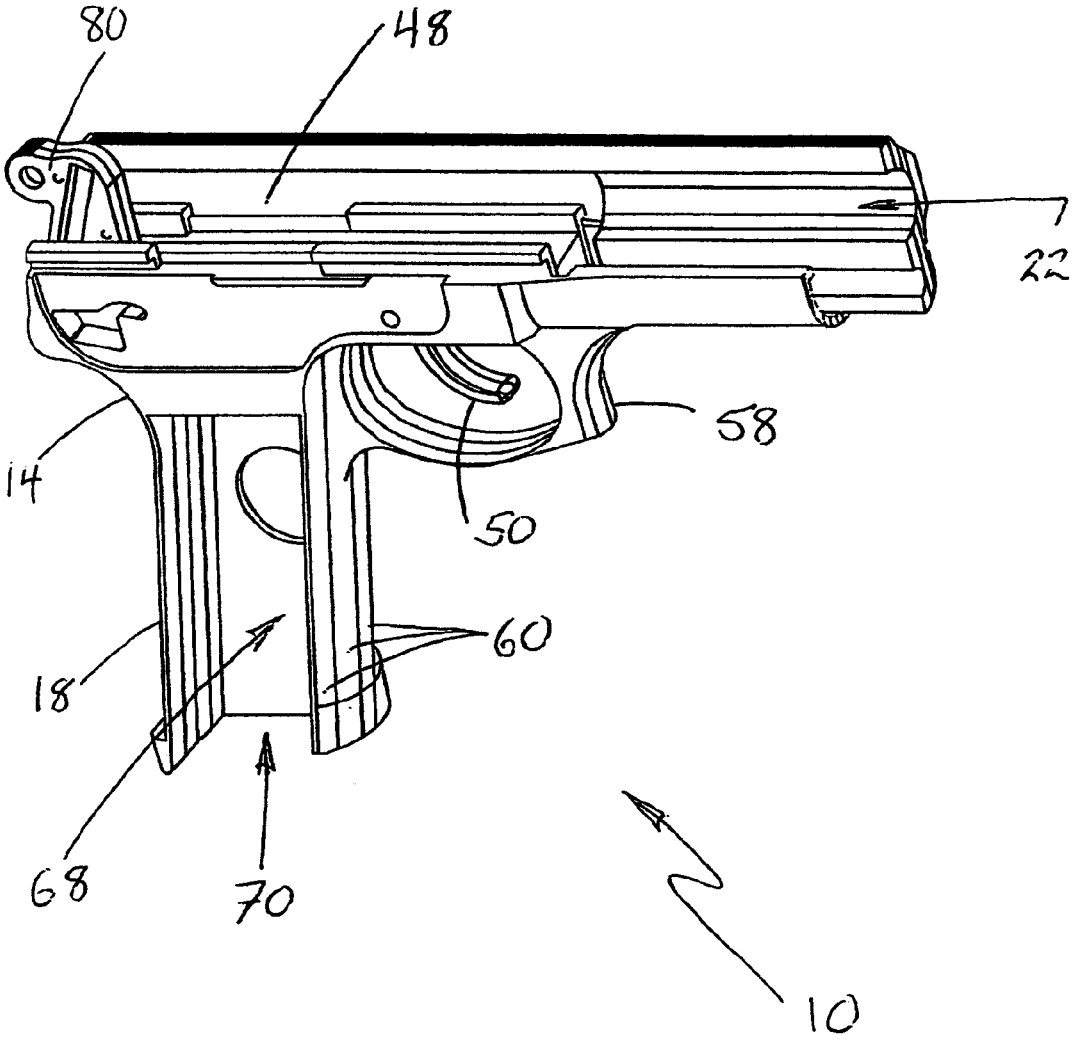
FIG. 2 is a simplified pictorial representation of the partially completed weapon of FIG. 1 with additional laminations removed to further illustrate the interior structure of the weapon

For purposes of illustration, the weapon 10 shown in FIG. 1 represents a well-known type of hand-held automatic pistol in which a slide 15, carries a barrel [not shown] mounted in a barrel-receiving passage 22. The slide 15 is mounted for linear, forward-and-rearward displacement relative to frame 14 in a well known manner. Referring now to FIG. 1 and FIG. 2, it can be seen that the overall thickness dimension of frame 14 is defined generally by the cumulative thickness of laminations 60, each lamination having a length dimension extending generally in the direction of the length of the weapon 10, a height dimension extending generally in the direction corresponding to the height of the weapon and a relatively slight thickness dimension extending generally in a direction perpendicular to the axis of the barrel passage 22. Accordingly, it can be seen that the cumulative thicknesses of the laminations 60, when stacked in side-by-side relationship, build up to the full thickness dimension of weapon 10.

That is, in accordance with this invention, the full thickness of weapon 10 can be visualized as being made up of a series of longitudinal section views of the assembled weapon. Each section view then is formed into a very thin planar lamination 60 having full length and height dimensions and a corresponding minimum thickness dimension. Ideally, the thickness of each lamination 60 can be arranged so that one or both of its planar sides coincide with a required planar surface within the weapon structure. Now it can be recognized readily by those having ordinary skill in the weapons art, that a weapon may have many different required parallel planar surfaces, and some of these may be spaced from one another by the thickness of one or more laminations 60.

For example, with reference to FIG. 2, it can be seen that the lamination 60A at the leftmost edge of the figure includes a relatively large planar surface area portion 66. In use, this surface portion serves as a base for mounting a textured cover often called a "grip", not shown, of conventional design, that facilitates tactile handling of the completed weapon in a well-known manner.

As a further example of how a weapon is constructed in accordance with this invention, it can be seen most clearly in FIGS. 1 and 2 that frame 14 of weapon 10 includes a magazine receptacle portion 68 having the form of an enclosure within the frame characterized by an open end 70 for insertion of a bullet magazine carrier (not shown). The form and function of magazine receptacle portion 68 is well-known in the weaponry art, and is mentioned here for illustrative purposes, to more clearly disclose how a conventional weapon is constructed in accordance with this invention.

In addition to base opening 70, magazine receptacle 68 is defined in part by a first pair of opposed spaced apart sidewalls 62, 66, defined by specific surface areas on laminations 60A and 60D, and a second pair of opposed, spaced apart sidewalls 65, 67 defined by the cumulative thicknesses of corresponding specific edges 65B, 67B and 65C, 67C of laminations 60B, 60C etc. A fifth sidewall 63, of receptacle 68, positioned substantially opposite opening 70 completes the definition of receptacle area 68. Fifth sidewall 63 can be understood to be formed, in a manner corresponding to the formation of sidewalls 65, 67, by cumulative thicknesses 63B and 63C, for example of laminations 60B and 60C and as many additional laminations as may be desired to establish the chosen cumulative thickness dimension of walls 63, 65, 67.

A significant advantage of the form of weapon structure herein disclosed is the elimination of any need for expensive and time consuming machining operations to form, just for example, cartridge receptacle 68. In accordance with the prior art, frame 14 of weapon 10 might be defined by two separate half sections lying on either side of a central plane passing through the center of grip 18 and the central axis of a barrel positioned in barrel supporting passage 22. In such a construction, each half section of the receptacle would require significant milling and/or broaching and finish machining operations to establish the closely parallel sides, the smoothly finished large surface areas and the close dimensional tolerances required to assure smooth and reliable insertion and removal of cartridges into and out of the receptacle space. Such machining operations would also be required to complete all of the various other grooves, recesses and openings in the two half sections that are required to form a weapon of any conventional design.

In a manner similar to the formation of receptacle area 68 through use of planar surfaces 62, 66, and the cumulative laminar dimensions of sidewalls 63, 65, 67, other openings, grooves, recesses and passages may be formed in the built-up, laminated structure of frame 14 to define the shapes and parts required for a functioning weapon, in accordance with this invention.

Figure 3:
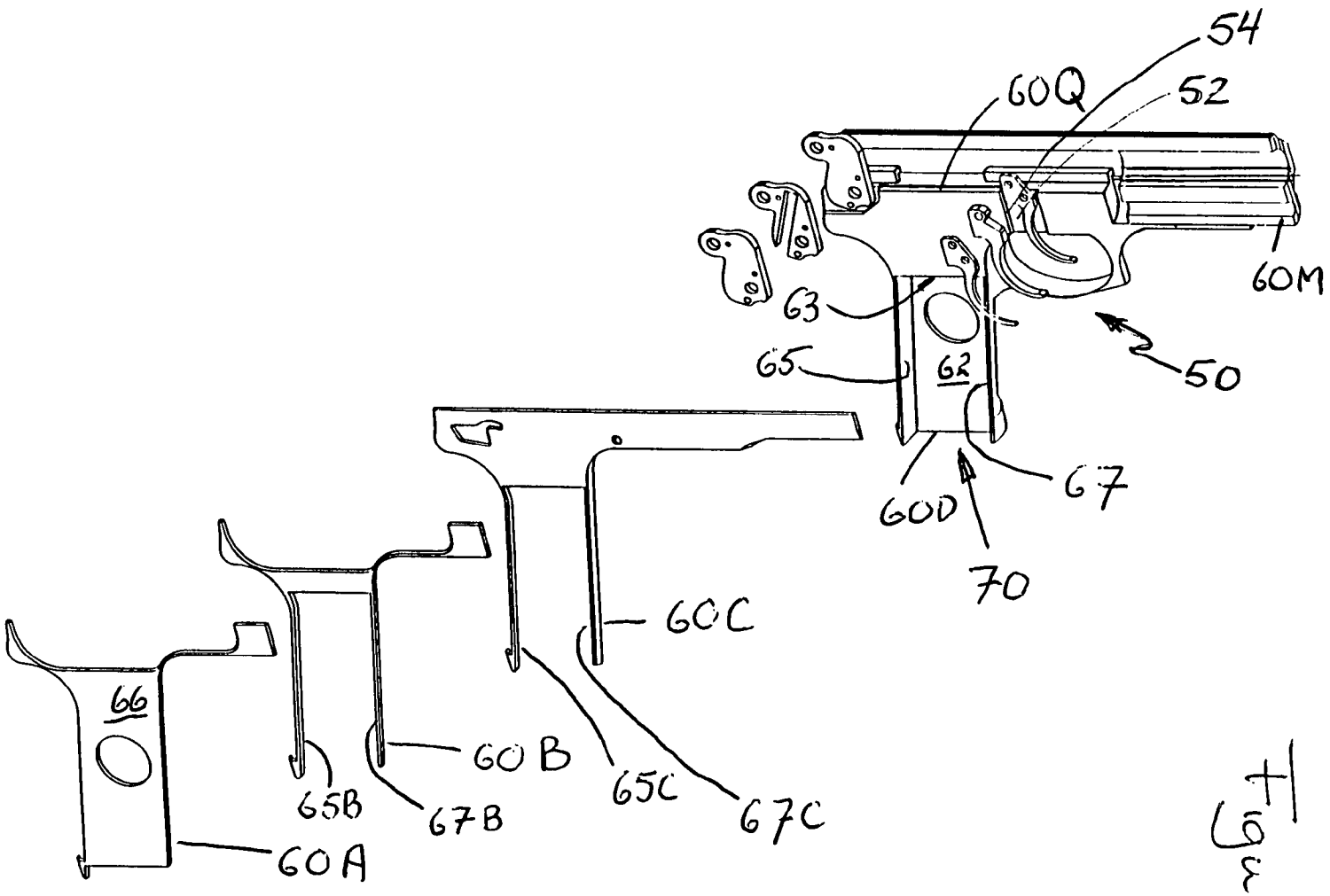
FIG. 3 is a partly exploded pictorial representation of illustrative parts of the weapon of FIG. 1.
Figure 4:
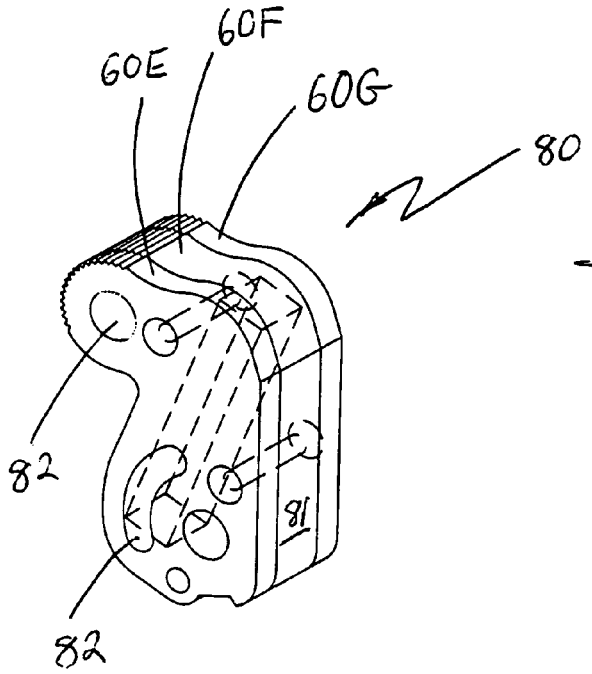
FIG. 4 is a simplified pictorial representation of a separate internal part of a weapon such as the weapon of FIG. 1, fabricated in accordance with this invention.
Figure 5:
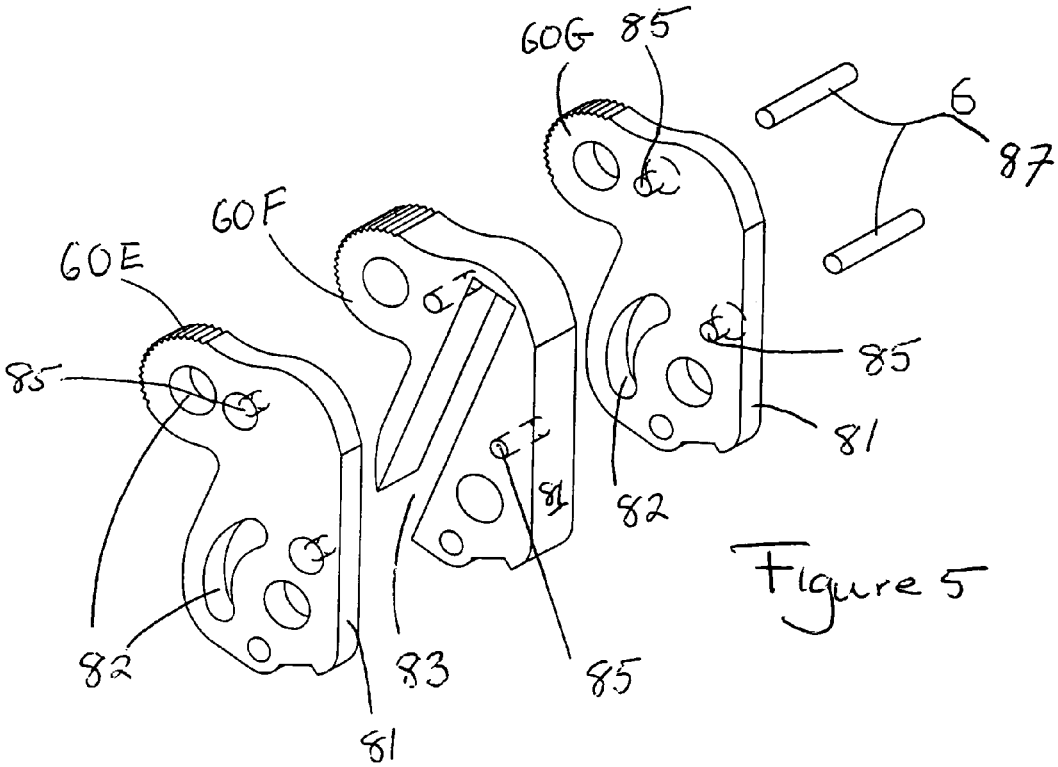
FIG. 5 is an exploded pictorial representation of the weapon part illustrated in FIG. 4.

With reference to other, separate parts that interrelate to, and interact with, frame 14 to complete a functioning weapon of otherwise conventional design, FIG. 3 illustrates how a conventional trigger element 50, which is formed of a plurality of laminar elements, 60H, 60J and 60K in accordance with this invention, is seated in a through-slot 52 formed in frame 14. Through-slot 52 is defined by a first pair of sidewalls, 53C, 53M located in opposed, parallel, spaced-apart relationship to each other, in combination with a second pair of parallel, opposed spaced-apart sidewalls that are oriented at right angles to the first pair. The first pair of sidewalls, 53C, 53M, is defined by corresponding surface areas on one of the two surfaces of each of two spaced-apart laminations 60C, 60M, while the second pair of sidewalls, substantially at right angles to the first, is formed by the opposed edges 54 of a cutout in one or more laminations such as lamination 60Q FIG. 4 of the drawings illustrates a hammer element 80 of otherwise conventional form and function constructed in accordance with this invention. FIG. 2 illustrates hammer element 80 in its conventional position relative to a breech chamber area 48 in a weapon of the kind illustrated herein. In turn, FIG. 5 is an exploded view showing the construction of hammer 80 in accordance with this invention. With reference to FIG. 5, hammer element 80 can be seen to be made up of three separate laminations, 60E, 60F and 60G, each having a substantially identical outer peripheral shape 81. However, outer laminations 60E and 60G include a variety of substantially identical through-openings 82, while center lamination 60F includes at least one different through-opening 83 in the form of a slot extending through the outer periphery 81 of that lamination. Accordingly, when the three laminar elements 60E, 60F and 60G are joined together in laminated relationship to form the composite complete hammer 80, slot 83 becomes a deep longitudinal channel within the body of the hammer, as shown in dotted lines in FIG. 4.

With further reference to hammer 80, breech chamber area 48 is defined within frame 14 by laminar elements 60 of the frame, in accordance with this invention. The breech chamber is used to receive and position bullets for firing, relative to hammer 80, in an entirely conventional manner. The additional mechanism and structure required to achieve this function is well-known in the art, and accordingly it is not illustrated or described in further detail herein. However, it will be recognized that any such structural elements of a breech mechanism may be fabricated of laminar elements in accordance with this invention.

At this point it will be obvious to those skilled in these arts that, regardless of the labor expense and effort invested in creating the high-precision tools needed to manufacture parts such as laminations 60E, 60F and 60G, those costs are incurred only once in the production of a great many such parts. As a result, from an overall standpoint, the per-part cost for each laminar element 60 is continually reduced as the number of production parts increases. Lamination, or secure, permanent joining together of the laminar elements identified generically by reference numeral 60 herein, can be accomplished in any number of ways using materials and processes that are well known in various arms of the manufacturing and fabrication arts. As shown in FIG. 5, laminations 60 be mechanically "pinned" together by providing the laminations, such as 60E, 60F, 60G with aligned pin openings 85 into which pin members 87 of any suitable known design may be forced to maintain the laminations in desired side-by-side alignment. To further assure proper retention of the laminated relationship, pins 87 may be axially compressed under force, after insertion, to expand their diameter and enhance their force fit within openings 85. In a related manner, pins 85 may be applied in the form of rivets to hold the laminations together. Those having skill in the related manufacturing arts will understand, in this context, that various and other apparatus, materials, and methods including, but not limited to capture riveting, adhesive bonding, molecular bonding, and cold welding, are readily available for use in forming coherent laminar structures in accordance with the invention herein disclosed. The surfaces of the laminations may, for example be bonded together by any number of suitable mechanical and/or chemical bonding agents; subject to proper considerations of material strengths and thicknesses, threaded fastenings may be used; and, if desired and otherwise suitable, combinations of any and all of these and other available laminating technologies may be used without departing from the spirit and scope of this invention.

Further, it will be understood that the materials forming the laminar layers of the frame and other elements of a weapon in accordance with this invention may be chosen specifically in accordance with the properties and characteristics they exhibit and the ones that are particularly suited to the part of the weapon they define. The materials of the various lamination body elements 60 may, if desired differ from each other. Accordingly, and by way of example only, laminations may be formed of plastic, aluminum, stainless steel, graphite, and titanium alloy as well as any of the various high strength composite materials currently available, and different ones of these materials may be abutted against each other to achieve desirable combinations of their characteristics.

Although a preferred embodiment of the invention has been illustrated and described, those having skill in this art will recognize that various other forms and embodiments now may be visualized readily without departing significantly from the spirit and scope of the invention disclosed herein and set forth in the accompanying claims.

What is claimed is:

1. A method of fabricating an operating lightweight firearm weapon and the relatively movable operating parts thereof, said method comprising the steps of:

selecting three coordinate axes defining said operating parts of said weapon in three dimensions;

forming thin laminations defining said operating parts, said laminations corresponding to plan views of said operating parts parallel to two of said coordinate axes taken at sequential positions along the third of said coordinate axes;

securely fastening said sequential laminations to each other to define a three-dimensional operating part wherein the thickness of said operating part represents the cumulative thickness of each of said laminations, combined; and, movably coupling a plurality of said operating parts to each other for operative interaction.

2. The method of claim 1 wherein:

said step of securely fastening said sequential laminations to each other comprises adhesive bonding.

3. The method of claim 1 wherein:

said step of securely fastening said sequential laminations to each other comprises capture riveting.

4. The method of claim 1 wherein:

said step of securely fastening said sequential laminations to each other comprises molecular bonding.

* * * * *